US006783029B2

(12) United States Patent
Schneider

(10) Patent No.: US 6,783,029 B2
(45) Date of Patent: Aug. 31, 2004

(54) FIXING HEAD FOR TUBES

(75) Inventor: Bernard Schneider, Menehould (FR)

(73) Assignee: Cebal S.A., Clichy (FR)

( * ) Notice: Subject to any disclaimer, the term of this patent is extended or adjusted under 35 U.S.C. 154(b) by 201 days.

(21) Appl. No.: 10/070,433

(22) PCT Filed: Jul. 18, 2001

(86) PCT No.: PCT/FR01/02335

§ 371 (c)(1),
(2), (4) Date: Apr. 26, 2002

(87) PCT Pub. No.: WO02/08079

PCT Pub. Date: Jan. 31, 2002

(65) Prior Publication Data

US 2002/0170924 A1 Nov. 21, 2002

(30) Foreign Application Priority Data

Jul. 24, 2000 (FR) ..... 00 09653

(51) Int. Cl.[7] ..... B65D 43/14; B65D 35/00

(52) U.S. Cl. ..... 222/92; 222/558; 215/235; 220/833; 220/837

(58) Field of Search ..... 222/92, 107, 556, 222/557, 558; 215/235, 236, 900; 220/780, 781, 782, 789, 790, 791, 793, 810, 820, 833, 836, 837

(56) References Cited

U.S. PATENT DOCUMENTS

| | | | | |
|---|---|---|---|---|
| 4,470,521 A | | 9/1984 | Scammell | |
| 4,610,371 A | | 9/1986 | Karkiewicz | |
| 5,123,561 A | | 6/1992 | Gross | |
| 5,213,235 A | * | 5/1993 | Miranda | 222/107 |
| 5,271,531 A | | 12/1993 | Rohr | |
| 6,311,316 B1 | * | 10/2001 | Huggins et al. | 215/204 |
| 6,371,316 B1 | * | 4/2002 | Herr et al. | 215/204 |

* cited by examiner

*Primary Examiner*—Kenneth Bomberg
*Assistant Examiner*—Patrick Buechner
(74) *Attorney, Agent, or Firm*—Dennison, Schultz, Dougherty & MacDonald

(57) ABSTRACT

A tube provided with a head and a skirt having an orthogonal cross section of particular shape in which the largest inscribed circle has a diameter D. The head, which is designed for fixing of a rigid closure, is provided with a circular cylindrical wall extending towards the inside of the tube and enclosing an orifice concentric to the inscribed circle and having a large diameter, typically more than 0.8D, and takes up substantially the internal volume of the skirt end over a height less than D, preferably less than D/3. The invention is further directed to a closure element, in particular a convenience closure, adapted for fixing substantially irreversibly on the tube head, comprising a base having an external outline matching the shape of the orthogonal cross section of the tube skirt, and a skirt having a diameter in the range of 0.5D to 0.9D.

16 Claims, 2 Drawing Sheets

FIXING HEAD FOR TUBES

FIELD OF THE INVENTION

The invention concerns flexible tubes intended for storing and dispensing liquid products of varying viscosity, in the form of gels, creams or pastes, typically toothpaste or cosmetic products. These tubes have a head which has neither neck nor shoulder, the skirt being directly adjacent to a rigid capping. Said rigid capping is formed either of an end part fitted with a cap, or with a hinge cap comprising a base and an end cap which pivots around a hinge attached at the base used to close a dispensing aperture arranged on said base.

DESCRIPTION OF RELATED ART

Numerous documents disclose said tubes whose head, which has neither a neck nor a shoulder, is both reduced in size and has an original, attractive appearance.

Often the end of the tube is directly fitted with a service cap. Document U.S. Pat. No. 4,470,521 for example describes a tube having an elongated, elliptical or polygonal section fitted with a service cap substantially in the extension of the skirt, the hinge being positioned on the circumference in the zone of the long axis, and the dispensing aperture being positioned as far as possible from said hinge. In addition to its debatable ease of use on account of the scarcely practical hinge position, this tube is moulded in a single material which does not make it possible to obtain a tube which satisfactorily meets constraints of use: the skirt must be very flexible to allow good restitution of the product contained in the tube, but the hinge must be able to withstand mechanical demands (mainly bending, but also twisting and extension) placed on the hinge throughout the time of use of the dispenser tube. Yet good fatigue resistance is not obtained with the most flexible plastic materials (typically low density polyethylene) but with stiffer materials (typically polypropylene) which, in addition, do not have fusion compatibility with the more flexible materials of the skirt, such as low density polyethylene. Moreover, for service caps, problem-free repeated closing of the cap requires a capsule in rigid material. The cap must pivot around its axis so that the various components intended to cooperate with one another to close the dispensing aperture and temporarily fix the cap to its base may do so in repeated manner and always by positioning themselves exactly opposite one another. To produce such tubes by injection moulding of a single material, persons skilled in the art are therefore compelled to find a delicate compromise between two opposing requirements which does not make it possible to obtain satisfactory tubes.

French model 98 7300 published under numbers 535 807 to 535 814 (L'Oréal) provides a tube with neither neck nor shoulder which is both reduced in size and of pleasing, original appearance. The tube is elliptical, the service cap is positioned in the extension of the skirt but, unlike the tube in U.S. Pat. No. 4,470,521, the hinge is positioned in the zone of the short axis which makes the tube easier to hold during the various cap handling operations. However, this tube raises the same problem as the previous tube: if it is produced by injection moulding in a single material, this material can only be a compromise between two opposing requirements.

Since injection moulding with a single material does not lead to a satisfactory solution, the applicant sought to bring about co-existence between the flexible skirt material and the rigid material of a capping such as described by French model 987300. It is not sufficient to solve the problem of fusion compatibility, there is also the problem of the tube's percentage of product restitution; when the tube is nearly finished, the user has to try and expel the product remaining in the vicinity of the rigid cap and is no longer able to press the skirt with the same efficacy as when the middle of the skirt is pressed.

The applicant has therefore set out to produce a tube, under satisfactory economic conditions, which comprises a more compact head than conventional heads with a neck and shoulder, said tube making it nevertheless possible to obtain a product restitution percentage of over 85% with rigid capping directly adjacent to a flexible skirt.

SUMMARY OF THE INVENTION

The first subject of the invention is a tube fitted with a head intended to fix capping, the second subject of the invention described below, and with a cylindrical or prismatic skirt having an orthogonal section of any shape (elliptical, round, polygonal, etc..) whose largest inscribed circle has a diameter D, characterized in that the head is provided with a round cylindrical wall extending towards inside the tube and surrounding an opening that is concentric to said inscribed circle, said opening—which will be hereinafter called "large-diameter-opening" for simplification—having a diameter typically lying between 0.5*D and 0.9*D, and in that it essentially occupies the inner volume of the skirt end over a distance that is less than D, preferably less than D/3.

Therefore the capping is not fixed directly to the skirt but on a head of special shape, largely flattened, so as to take up as little space as possible. The capping is fitted with a circular skirt whose diameter is equal to or slightly greater than the diameter of the large-diameter-opening of the head. To fix this capping to the tube, said cylindrical skirt is force fitted into the round cylindrical wall surrounding the large-diameter-opening as far as its end position. The open end of the capping skirt is provided with substantially irreversible interlocking means such as a click-fit rim which relaxes outwardly under elastic effect as soon as it passes through the lower end of the cylindrical wall surrounding the opening.

In this manner, a rigid, sealed contact is made at the large-diameter-opening. The head, made in a fusion compatible material with the material of the skirt, is sufficiently flexible so that its peripheral part, which corresponds to the junction between head and skirt, is able to undergo substantial deformation, whereas the adjacent parts corresponding to the rigid capping remain non-deformed. With such deformability it is possible to obtain a high product restitution percentage despite the presence of the rigid capping in the vicinity of the tube end.

The zone next to the cylindrical wall which surrounds the large-diameter-opening must be little deformable however, since the cylindrical wall in cooperation with the cylindrical capping skirt must ensure two functions: sealing and substantially irreversible interlocking. Said cylindrical wall must be sufficiently distant from the deformable peripheral part of the tube so that the major deformations applied to this peripheral part lose their magnitude when transmitted to the cylindrical wall which surrounds the large-diameter-opening. On this account, the diameter of the so-called large-diameter-opening is limited to 90% of the diameter of the largest inscribed circle.

Also, the cylindrical wall surrounding the large-diameter-opening participates in the rigidity of the head. It is in this sense that the opening must have a large diameter, typically greater than 0.5 times the diameter of the largest inscribed circle, bearing in mind that it may be smaller if other means are used to rigidify said head, such as the means described below in a particular embodiment in which the head is provided with bosses.

The head occupies the inside of the volume delimited by the skirt end over a short distance. It therefore takes up little volume. In this manner, the quantity of material to be moulded is reduced which may lead to advantageous economic consequences regarding material costs and even production rates when the head is moulded and simultaneously welded to the skirt. Typically, the height of the round cylindrical wall surrounding the large-diameter-opening is less than D and preferably less than D/5.

Preferably, the head is also provided with a peripheral wall which extends the skirt of the flexible tube by a small distance, typically in the order of one millimetre, being slightly staggered inwards so that the edge so formed can be used for the fitting of a peripheral skirt attached to the base of the rigid capping. Since the stagger distance corresponds to the thickness of said peripheral skirt attached to the base of the rigid capping, the outer contour of the capping obtained exactly extends the cylindrical or prismatic shape of the skirt.

If the user wishes to dispense product when the tube is nearly finished, pressure is applied close to the capping. This causes strong deformation of the peripheral part of the tube, in particular at the junction between skirt and head. This part undergoes strong deformation opposite the rigid capping part positioned in its extension, and such great difference in deformation gives an unattractive gaping impression. By means of the edge provided on the head covered by the peripheral skirt of the rigid capping, said gaping is avoided since the differential deformation between capping and tube leads to mere movement of the edge behind the peripheral skirt of the capping, and not to the creation of a dark interstice separating the two parts.

If the capping is a hinge cap, said peripheral wall is advantageously provided with slots to house hinge extension parts. To achieve maximum compactness the extension parts, of similar thickness to the thickness of the peripheral skirt of the cap, must have their point of attachment as low as possible on said peripheral skirt, of which the consequence is a increase in the local thickness of said peripheral skirt at the point where the latter is to be fitted into the peripheral wall of the head.

If the orthogonal section of the skirt is not a circle centred over the axis of the large-diameter-opening, the edge—whose section is deduced by staggering the orthogonal section of said skirt over a skirt thickness—completes the substantially irreversible interlocking system of the capping on the tube, and also allows locking in place of the capping by rotating the cap around the axis of the large-diameter-opening.

The head has an end wall which joins the circular cylindrical wall surrounding the large-diameter-opening to the outer wall in staggered extension of the skirt. To further improve the tube's percentage of product restitution, said end wall comprises bosses entering inside the inner volume of the skirt end, each boss having a bottom wall whose slope is inclined along a plan perpendicular to the axis of the opening, which facilitates product flow forced to converge towards the central opening. In a sense, the bottom wall of these bosses is in the shape of a shoulder which causes flow of product towards the round cylindrical wall. To limit head size, these bosses must not be too deep. Their depth is limited to D, preferably to D/3.

Each boss also has a side wall whose shape is deduced by staggering the shape of the skirt and cylindrical wall surrounding the large-diameter-opening The stagger distance must be as small as possible, typically less than D/10, to minimize the quantity of product likely to be trapped.

In addition to their advantageous effect on the percentage of tube restitution, these bosses also make it possible to have a more rigid head. Firstly, the deformation differences between skirt and capping are reduced so that the gaping effect is less apparent. Secondly, these bosses better insulate the round cylindrical wall surrounding the large-diameter-opening in the sense that the deformations are only weakly transmitted to said wall.

One preferred embodiment is the tube corresponding to French model 987300; the tube has an elliptical skirt providing a more legible backdrop than a round skirt, and the capping is an elliptical service cap in the extension of the skirt which must be oriented relative to the backdrop provided by the elliptical skirt. To ensure proper orientation of the service cap at the time of its substantially irreversible fixing to the tube, the head is provided with a positioning peg oriented towards the inside of the tube, such as described in French patent application n° 0004568. The large-diameter-opening (diameter between 0.5 and 0.9 times the short axis of the ellipse) in this case is crossed by arms and partly closed by a net supporting said positioning peg.

The net is positioned between the arms in a zone overlapping the long axis so that it does not obstruct the small dispensing aperture located in the zone of the short axis. The bosses occupy the complementary part of the ellipse, formed by two zones extending around the long axis, the end wall following the contour of a shoulder, thereby improving product restitution of the tube so produced.

A second subject of the invention is the capping able to be fixed in substantially irreversible manner to the head of the tube of the invention, characterized in that it comprises a base whose outer contour follows the orthogonal-shaped section of the skirt of said tube and is fitted with a skirt—hereinafter called "large-diameter-skirt" —whose diameter typically lies between 0.5*D and 0.9*D, D being the diameter of the largest circle inscribed in the outer contour of the base. The height of said large-diameter-skirt is smaller than D, preferably less than D/3, and is provided with substantially irreversible fixing means to join the capping to the head of the tube. These may for example by a click-fit rim which relaxes outwardly under elastic effect as soon as it passes through the lower end of the cylindrical wall surrounding the large-diameter-opening of the tube head. To facilitate the centring of the large-diameter-skirt in said round cylindrical wall, the click-fit rim preferably occupies the open end of the large-diameter-skirt of the capping, and its surface is of blunt cone shape converging towards the inside of the tube.

Through coherency with the problem raised, the capping is in a rigid material and the base of the capping is flat for maximum compactness, and to minimize the weight of the upper part of the dispenser tube formed by the capping and flexible tube assembly. However, this type of fixing system, even if less advantageous from an economic viewpoint, may be mounted on other types of capping that are less rigid or have a more voluminous base.

The large-diameter-skirt has a cylindrical part whose diameter is equal to or slightly larger than the diameter of the large-diameter-opening so that the contact between the large-diameter-skirt and the round cylindrical wall surrounding the large-diameter-opening is perfectly sealed, even when the skirt is largely deformed in the vicinity of the head. To fix the capping to the tube, said skirt is force-fitted in the round cylindrical wall surrounding the large-diameter-opening until it is immobilized in its end position.

As described previously, the capping base is preferably also fitted with a peripheral skirt which fits around the edge of the head of the tube of the invention. This skirt can hide the unattractive gaping due to deformation differences between the flexible skirt and the rigid capping. Also, if the outer contour of the base is not a circle centred over the axis of the large-diameter-skirt, this peripheral skirt fitted around the said edge can also be used to immobilize the capping by rotation on the tube.

The capping may be a service cap. The hinge around which the cap pivots is made up of at least one film hinge and at least one extension part. Preferably it comprises a central film hinge surrounded by two extension parts. To take up as little space as possible, the extension parts whose thickness is closely similar to the thickness of the peripheral skirt of the cap, must be attached as low as possible on said peripheral skirt, of which the consequence is a local increase in the overall thickness of said peripheral skirt to arrange housings therein to house said extension parts when the end cap is folded over the base.

The large-diameter-skirt belongs to the capping made, in theory, in rigid material. This skirt therefore behaves in rigid manner which may cause some problems at the time of fixing the capping to the tube head under fast production rates. To facilitate the force-fitting of said skirt in the round cylindrical wall surrounding the large-diameter-opening, the large-diameter-skirt is fitted with ease notches. These ease notches may be fairly extensive and form cavities facilitating product flow towards the large-diameter-opening and hence towards the dispensing aperture, which improves the tube's product restitution.

In one preferred embodiment, these ease notches are firstly cavities of trapezoid shape widening towards their base and facilitating the proper positioning of the large-diameter-skirt on the arms crossing the large-diameter-opening, and secondly are cavities which facilitate product flow towards the large-diameter-opening.

A final subject of the invention is the dispenser tube obtained through assembly of the flexible tube of the invention and the capping of the invention.

DESCRIPTION OF THE PREFERRED EMBODIMENTS

Figure 1:
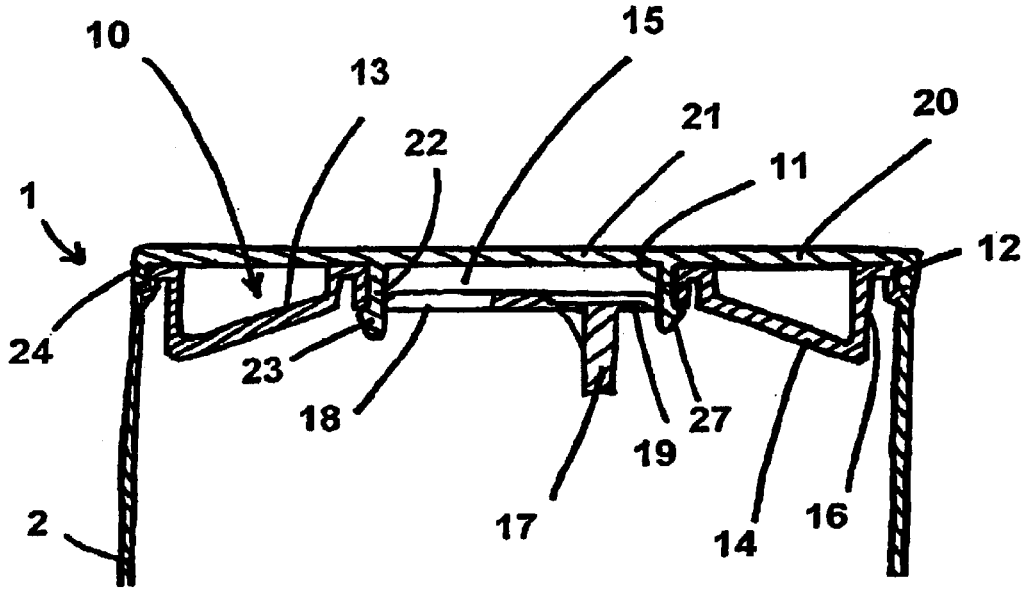
FIG. 1 illustrates a dispenser tube of the invention with a flexible tube of the invention and capping of the invention of which only the base is shown.
Figure 2:
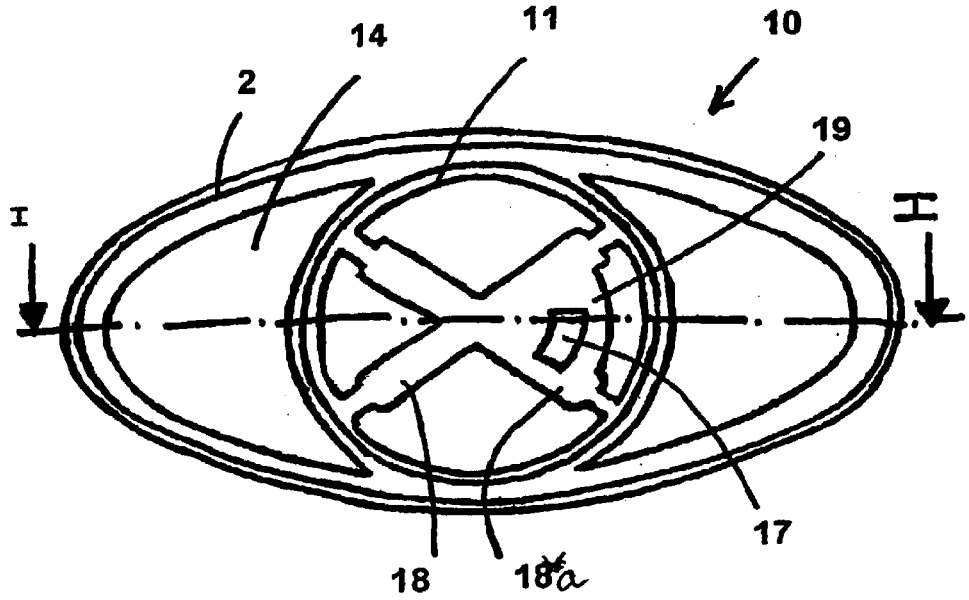
FIG. 2 is an underside view of the flexible tube of the invention shown in FIG. 1.
Figure 3:
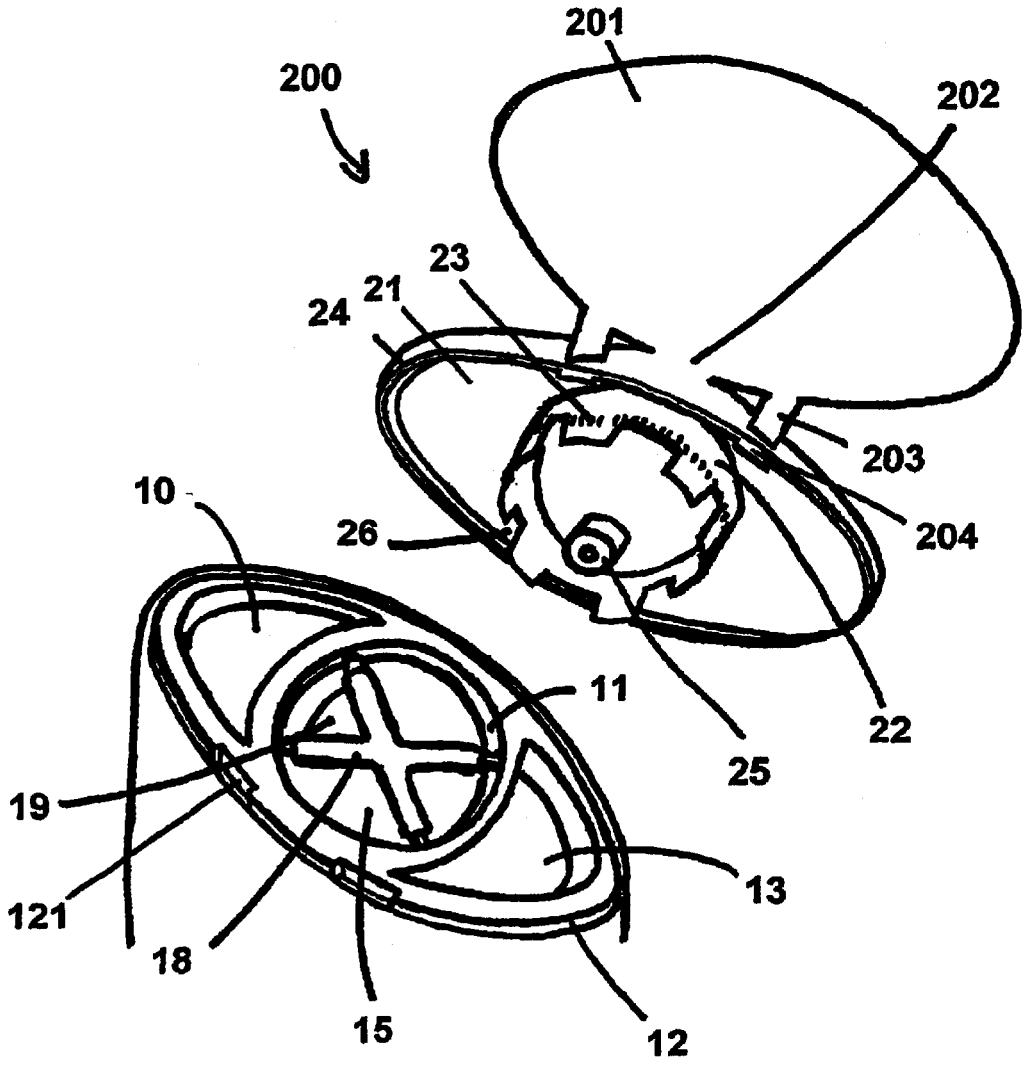
FIG. 3 is a panoramic view of the flexible tube of the invention illustrated in FIGS. 1 and 2, and of the capping of the invention whose lower surface is shown arriving opposite the head of the flexible tube.

EXAMPLE (FIGS. 1, 2 and 3)

This example corresponds to a solution put forward to produce the dispenser tube, under economically acceptable conditions, that is described in French model 98 7300 published under number 535 807 to 535 814 by L'Oréal. Evidently, the head of the flexible tube and the fixing/sealing skirt—so-called "large-diameter-skirt"—developed in this example are not limited to the particular shapes of the model and may be adapted to numerous other types of dispenser tubes.

Tube 1 is fitted with a head 10 intended for the fixing of a service cap 200—of which only the base is shown in FIG. 1—and with an elliptical skirt 2 whose largest inscribed circle has a diameter D of 32 mm equal to the short axis of the ellipse. The head 10 is provided with a circular cylindrical wall 11 extending towards the inside of the tube over a distance of 3.5 mm—i.e. approximately D/9—and surrounding an opening 15 concentric to said inscribed circle. This opening hereinafter called "large-diameter-opening" has a diameter of 27 mm.

Capping is a service cap 200 whose base 21 is fitted with a skirt 22 of large diameter. To fix this capping to the tube, said large-diameter-skirt is force-fitted into the circular cylindrical wall 11 surrounding the large-diameter-opening 15 until it is immobilized in its end position. The open end of the large-diameter-skirt 22 is provided with a click-fit rim which relaxes outwardly under elastic effect as soon as it passes through the lower end of the cylindrical wall 11 surrounding the large-diameter-opening 15. To facilitate centring of the large-diameter-skirt 22 within the circular cylindrical wall 11, the click-fit rim occupies the open end of the large-diameter-skirt of the capping, and its surface is in the shape of a blunt cone 27 converging towards the inner part of the tube.

The head is made of high density polyethylene (HDPE) a material that has fusion compatibility with the materials of the multilayer skirt of general structure: PE/EMA/EVOH/EMA/PE. It is sufficiently flexible so that its peripheral part, corresponding to the junction between head and skirt, is able to undergo major deformation whereas the corresponding adjacent parts of the service cap, in polypropylene, are not deformed. With such deformability it is possible to obtain good product restitution despite the presence of the rigid capping close to the end of the tube.

The head 10 essentially occupies the inner volume of the skirt end over a distance of less than 10 mm. In this manner, the quantity of material to be moulded is reduced, which makes it possible to increase production rates as the head is injection moulded and simultaneously welded to the skirt.

The head 10 is also provided with a peripheral wall 12 which, over a small distance, typically in the order of one millimetre, extends the skirt 2 of the flexible tube and is recessed inwardly by 0.4 mm. The edge so formed is used to fit a peripheral skirt 24 attached to the base 21 of the service cap 200.

The wall of the peripheral skirt 24 is provided with slots 121 able to receive the housings 204 of the extension parts 203 of the hinge.

The head 10 has an end wall joining the circular cylindrical wall 11 surrounding the large-diameter-opening 15 to the outer wall 12 in staggered extension of skirt 2. To further improve the tube's product restitution, said end wall is provided with bosses 13 entering the inner volume of the end of the skirt, each boss 13 having a bottom wall 14 in the shape of a shoulder which leads product flow towards the large-diameter-opening 15. The maximum depth of these bosses 13 is 10 mm.

Each boss 13 also has a side wall 16 whose shape is deduced by staggering the shape of the skirt and cylindrical wall surrounding the large-diameter-opening over a distance of approximately 1 millimetre.

To ensure proper orientation of the service cap 200 at the time of its substantially irreversible fixing to the head 10 of flexible tube 1, the head 10 is provided with a positioning peg 17 oriented towards the inside of the tube. The large-diameter-opening 15 is crossed by arms 18 and 18*a* and is partly closed by a net 19, the arm and net assembly supporting said positioning peg 17 of which one surface bears on a substantially diametric plane, and which has two cylindrical surfaces surrounding said surface and extending over an angle of at least 10°, and an apex surface with a spiral slope. These surfaces are respectively denoted 91, 92, 93 and 94 in FIG. 2 of French patent application n° 0004568.

Net 19 is placed between arms 18 and 18*a* in a zone overlapping the long axis so that it does not obstruct the small dispensing aperture 25 positioned in the zone of the short axis.

The large-diameter-skirt 22, has a cylindrical part whose diameter is equal to or slightly greater than the diameter of the large-diameter-opening 15 such that the contact between the large-diameter-skirt 22 and the circular cylindrical wall 11 surrounding the large-diameter-opening 15 is perfectly sealed, even when the skirt is greatly deformed in the vicinity of the head.

The large-diameter-skirt is provided with ease notches 26. These ease notches may be fairly wide and form cavities facilitating product flow towards the large-diameter-opening 15 and therefore towards the dispensing aperture 25, which improves the percentage of product restitution. In addition, some of these ease notches 26 are cavities of trapezoid shape widening towards their base and facilitating the proper positioning of the large-diameter-skirt 22 on arms 18 and 18*a* crossing over the large-diameter-opening 15.

For a product of average viscosity of between 2800 and 4000 centipoises, this type of tube offers a restitution capacity of more than 90%.

Advantages

Discrete fixing head, invisible once the cap is in place

Low head weight, therefore low quantity of material to be injected and increased production rates when the head is injection moulded and simultaneously welded onto the end of the skirt, Good product restitution by the tube so produced, despite strong rigidity of the capping.

LIST OF PARTS SHOWN IN FIGS. 1, 2 AND 3

1: tube
2: skirt
10. head
11. circular cylindrical wall surrounding central opening 15
12: peripheral wall
121: slots
13: bosses
14: end wall of bosses
15: large-diameter-opening
16: side wall
17: positioning peg
18, 18*a*: arm
19: net
20: capping/cap
21: base
22: large-diameter-skirt
23: substantially irreversible fixing means/click-fit rim
24: peripheral skirt
25: dispensing aperture
26: ease notch
27: blunt cone-shaped outer surface
200: service cap
201: end cap
202: film hinge (hinge part)
203: extension part (hinge part)
204: housing for extension part

What is claimed is:

1. Tube fitted with a head intended to fix capping, and with a cylindrical or prismatic skirt having an orthogonal section of any shape whose largest inscribed circle has a diameter D, the head comprising a circular cylindrical wall extending towards the inside of the tube, surrounding an opening concentric to the inscribed circle and having a diameter between 0.5*D and 0.9*D, wherein the head substantially occupies the inner volume of the end of skirt over a distance of less than D and wherein the head is fitted with an end wall comprising bosses entering the inner volume of the end of the skirt, each boss having a bottom wall having a slope inclined relative to the plane that is perpendicular to the axis of the opening.

2. Tube according to claim 1, in which the head is also provided with a peripheral wall which extends the skirt of the flexible tube over a short distance, and is slightly recessed inwards over a distance corresponding to the thickness of the peripheral skirt of the capping.

3. Tube according to claim 2 fitted with a head intended to fix a service-cap in which said peripheral wall is provided with cavities intended to receive housings of extension parts of the hinge.

4. Tube according to claim 2, in which the orthogonal section of the skirt is not a circle centered over the axis of the large-diameter-opening, so that the capping is also locked in rotation when it reaches it end position.

5. Tube according to claim 1, in which said bosses have a side wall whose shape is deduced by staggering the shape of the skirt (2) and of the circular cylindrical wall surrounding the large-diameter-opening, the stagger distance being less than D/10.

6. Tube according to claim 1, in which the lower part of the head is fitted with a jutting part oriented towards the inside of the tube.

7. Tube according to claim 6, in which the jutting part is a positioning peg attached to a net stretched between arms crossing over the large-diameter-opening.

8. Tube according to claim 1, in which the section of the skirt is an ellipse, the diameter of the large-diameter-opening lies between 0.5 and 0.9 times the short axis of the ellipse, and in which the bosses occupy the complementary parts of the ellipse formed by two zones extending around the long axis of the ellipse and have a side wall deduced by inner displacement of the elliptic skirt over a distance of about one millimeter and outer displacement of the circular cylindrical wall surrounding the large-diameter-opening.

9. Capping able to be fixed in substantially irreversible manner to the head of the tube according to claim 1, comprising a base having an outer contour following the shape of the orthogonal section of the skirt of said tube and fitted with a large-diameter-skirt having a diameter between 0.5*D and 0.9*D, D being the diameter of the largest circle inscribed in the outer contour of said base, said large-diameter-skirt having a height less than D, and being provided with substantially irreversible fixing means to fix the capping to the head of tube.

10. Capping according to claim 9, in which the large-diameter-skirt has a cylindrical part having a diameter equal to or slightly greater than the diameter of the large-diameter-opening of the tube head and an open end fitted with a click-fit rim with an outer surface of blunt cone shape.

11. Capping according to claim 9, in which the base is fitted with a peripheral skirt intended to be inserted around the edge of the tube head.

12. Service-cap according to claim 9, comprising a base and a cap end pivoting around a hinge, said hinge comprising at least one extension part, in which the attachment of the extension part on the base is fixed in a housing arranged in the lower part of the peripheral skirt.

13. Capping according to claim 9 in which the large-diameter-skirt is provided with ease notches.

14. Capping according to claim 13, in which the ease notches are firstly cavities of trapezoid shape widening towards the base which facilitate proper positioning of the large-diameter-skirt on arms crossing over the large-diameter-opening of the tube head, and secondly are cavities which facilitate product flow towards the large-diameter-opening.

15. Service cap according to claim 9 in which the peripheral contour of the base is an ellipse and in which the diameter of the large-diameter-skirt lies between 0.5 and 0.9 times the short axis of said ellipse.

16. Dispenser tube intended to store and dispense liquid products of varying viscosity in the form of gels, creams or pastes, obtained by assembling the flexible tube according to claim 1 with a capping comprising a base having an outer contour which follows the shape of the orthogonal section of the skirt of said tube and is fitted with a large-diameter-skirt having a diameter between 0.5*D and 0.9*D, D being the diameter of the largest circle inscribed in the outer contour of said base, said large-diameter-skirt having a height less than D, and being provided with substantially irreversible fixing means to fix the capping to the head of tube.

* * * * *